US006196703B1

(12) United States Patent
Eusterbrock et al.

(10) Patent No.: US 6,196,703 B1
(45) **Date of Patent: *Mar. 6, 2001**

(54) AUTOMATIC SHUTOFF SYSTEM

(75) Inventors: Paul W. Eusterbrock, Minneapolis, MN (US); Francis W. Camps, West Allis, WI (US)

(73) Assignee: Holtkotter International, Inc., St. Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/192,829

(22) Filed: Nov. 16, 1998

Related U.S. Application Data

(63) Continuation-in-part of application No. 08/882,605, filed on Jun. 25, 1997.

(51) Int. Cl.[7] ..... F21V 25/12

(52) U.S. Cl. ..... 362/276; 362/276; 362/802; 362/376; 362/265; 362/119; 324/332

(58) Field of Search ..... 362/276, 802, 362/376, 265; 315/119; 324/332

(56) References Cited

U.S. PATENT DOCUMENTS

| | | | | |
|---|---|---|---|---|
| 4,415,952 | | 11/1983 | Hattori et al. | 362/32 |
| 5,528,448 | | 6/1996 | Brenner et al. | 361/103 |
| 5,725,301 | * | 3/1998 | Jung | 362/276 |
| 5,733,038 | | 3/1998 | Wang | 362/394 |
| 5,921,661 | * | 7/1999 | Euster | 362/276 |

* cited by examiner

*Primary Examiner*—Sandra O'Shea
*Assistant Examiner*—Anabel M Ton
(74) *Attorney, Agent, or Firm*—Oppenheimer Wolff & Donnelly LLP; Craig J. Lervick

(57) ABSTRACT

A control system is provided for use in conjunction with a lighting fixture which will provide additional safety by avoiding the risk of fire. The safety system provides a number of sensors which are capable of detecting the presence of objects in close proximity to the lighting element and appropriately switching power off when such objects are detected. The actual detection is accomplished by use of a plurality of infrared sensors which create an infrared shield around the bulb of the lighting fixture and insure no objects intrude upon the shielded space while the lighting system is in operation. A second safety benefit is provided by the use of a tilt switch. The tilt switch cuts off power to the lamp if the lamp is tipped or knocked over.

29 Claims, 6 Drawing Sheets

AUTOMATIC SHUTOFF SYSTEM

This application is a continuation-in-part of application Ser. No. 08/882,605 filed Jun. 25, 1997, which is currently co-pending.

BACKGROUND OF THE INVENTION

The present invention relates to a safety device for use with lighting fixtures. More specifically, the present invention provides a safety shutoff system for use with lighting fixtures which avoids dangerous situations that could cause fires.

As is well known, lighting bulbs tend to become very hot during use. Consequently, care must be taken to provide appropriate shielding from the heat. This is particularly true in lighting fixtures which utilize halogen lighting elements. Should flammable materials come close to, or in contact with these bulbs, a real fire danger is created. The consequences of such a fire would be catastrophic resulting in harm to property and even the risk of death.

Typically, shielding or protection from the heat created by lighting bulbs has been accomplished by providing appropriate lamp shades or lamp coverings so as to avoid contact between the bulb and other elements. Alternatively, shielding has been accomplished by providing a bulb enclosure which completely surrounds the light bulb itself thus avoiding any contact. This shielding or protection is not always effective as the shield itself tends to absorb heat. Care must then be taken to protect objects from contacting either the shield or the bulb, so as to avoid risk of fire.

Previous methods of shielding from the heat of the bulb have been ineffective for a number of additional reasons. From a lighting perspective, it is undesirable to place elements in front of the light bulbs. Obviously, these elements, despite their physical makeup, will absorb some light and reduce the amount of light provided. Additionally, the need for shields or shades drastically limits the design flexibility in developing the lighting system. In order to create a shield which appropriately protects the bulb, but does not itself become dangerously hot, a relatively large structure is necessary. Consequently, alternative protection methods are necessary whenever a fairly sleek and compact lighting fixture is desired. Also, shielding itself does not necessarily prevent the risk of fire but rather simply delays it. More specifically, the shield may simply prevent a product from igniting for some period of time but does not eliminate the risk. Lastly, the shield will not likely protect from objects of all sizes. Small objects may pass through a mesh shield, for example.

In attempting to avoid the risk of fire danger, the reduction or elimination of heat in the bulb itself is not a viable option. As is well known, it is necessary for the bulb to be as efficient as possible at producing usable light. With today's lighting technology, this requires the use of higher power levels which necessarily generate both light and heat.

As can be expected, any contact with objects which are even remotely flammable can be very dangerous. For example, any contact between the light bulb and draperies or fabrics can potentially cause eruption into flames. Consequently, this entire situation must be avoided. Further, an active approach to avoiding the risk of fire is more desirable as these lighting fixtures are typically unattended. For example, lights are occasionally left on and windows are occasionally left open. It is not uncommon for draperies to be blown close to or in contact with the lighting fixture. If active protection from this threat of fire is included within the fixture, a much safer situation is created.

Another potentially dangerous problem can occur when these high intensity lamps are free standing. Particularly, when perched atop a tall, narrow support structure. Very little contact may be required to tip the lamp over. If this occurs, the heat source could be placed proximate various flammable materials. In the first situation, as described above, the lamp will usually be placed in a safe location and a problem will only occur if some type of material unexpectedly comes close to the bulb. With the tipping problem, however, this initial cautious placement is of no benefit. The lamp could tip and even subsequently slide or roll. Thus, bringing the heat source near a wide variety of hazardous materials, which may be ignited even if remaining some distance from the bulb.

SUMMARY OF THE INVENTION

The present invention provides for a safety system which will automatically shut off the lighting system when foreign objects come dangerously close to the light element. For example, should the wind blow draperies dangerously close to the light, the system of the present invention will cause power to be removed, thus avoiding any further danger of flames.

The automatic shutoff operation of the present invention is accomplished using a plurality of infrared emitter and detector pairs to create a "sensor shield" which completely surrounds the lighting element. More specifically, infrared light beams are directed between each emitter/receiver pair. Related circuitry can then be used to determine if the infrared beam is being disrupted. By positioning multiple emitter/receiver pairs in appropriate locations, the infrared beams will completely surround the lighting element. Consequently, these emitter/receiver pairs are capable of sensing the presence of an object in close proximity to the lighting element. Further, once these objects are removed the control system of the present invention allows power to be reapplied to the lighting element. This allows full operation of the light so long as no objects are present adjacent to the lighting element while also providing a safety shutoff.

Since the bulb will emit radiation which may coincide with that from the emitter, a mechanism is provided that will be able to discriminate between signals sent from the emitter and signals sent by the bulb. Additionally, the characteristics of the bulb may be somewhat inconsistent. The frequency of signals emitted by the bulb may change over time and may not be consistent from one bulb to another. To deal with these complications, the emitter is driven by a timer chip to emit the signal at a predetermined frequency. A differential amplifier is connected to the receiver which "tunes" the receiver to be responsive only to signals at the predetermined frequency and to reject other signals produced by the bulb.

Another aspect of the present invention is the inclusion of a tilt switch mechanism which will cut off power to the lamp, if the lamp is moved from its normal operating position. This creates a second safety system in addition to the above referenced emitter/receiver shield. For example, if a normally vertical lamp is accidentally knocked over, the lamp, and hence, the switch will be in a horizontal position. Elements within the switch are sensitive to this orientation and thereby open the circuit, preventing power from reaching the bulb or other portions of the control circuitry.

It is an object of the present invention to provide a lighting system which itself avoids the risk of fire danger when objects come in close proximity to the lighting element. This is accomplished by providing active sensors which detect the presence of objects in close proximity to the light and consequently shut the light off.

It is an object of the present invention to provide a safety system which will cause a light bulb to automatically shut off when objects are detected in close proximity to the light itself. The safety system will be fast acting and efficient by using infrared light.

It is another object of the present invention to provide a detection system utilizing infrared receiver and emitter pairs which will surround the lighting element of a light fixture. Consequently, when the infrared beams connecting this emitter/receiver pair are broken by objects, the light fixture will automatically shut off. Consequently, the lighting element will not generate undesirable heat, thus eliminating the risk of fire.

It is a further object of the present invention to provide a lighting controller which will avoid the risk of fire hazard by automatically shutting off when foreign objects are detected in close proximity to the lighting element.

BRIEF DESCRIPTION OF THE DRAWINGS

Further objects and advantages of the present invention can be seen by reading the following detailed description in conjunction with the drawings in which.

DETAILED DESCRIPTION OF THE INVENTION

Figure 1:
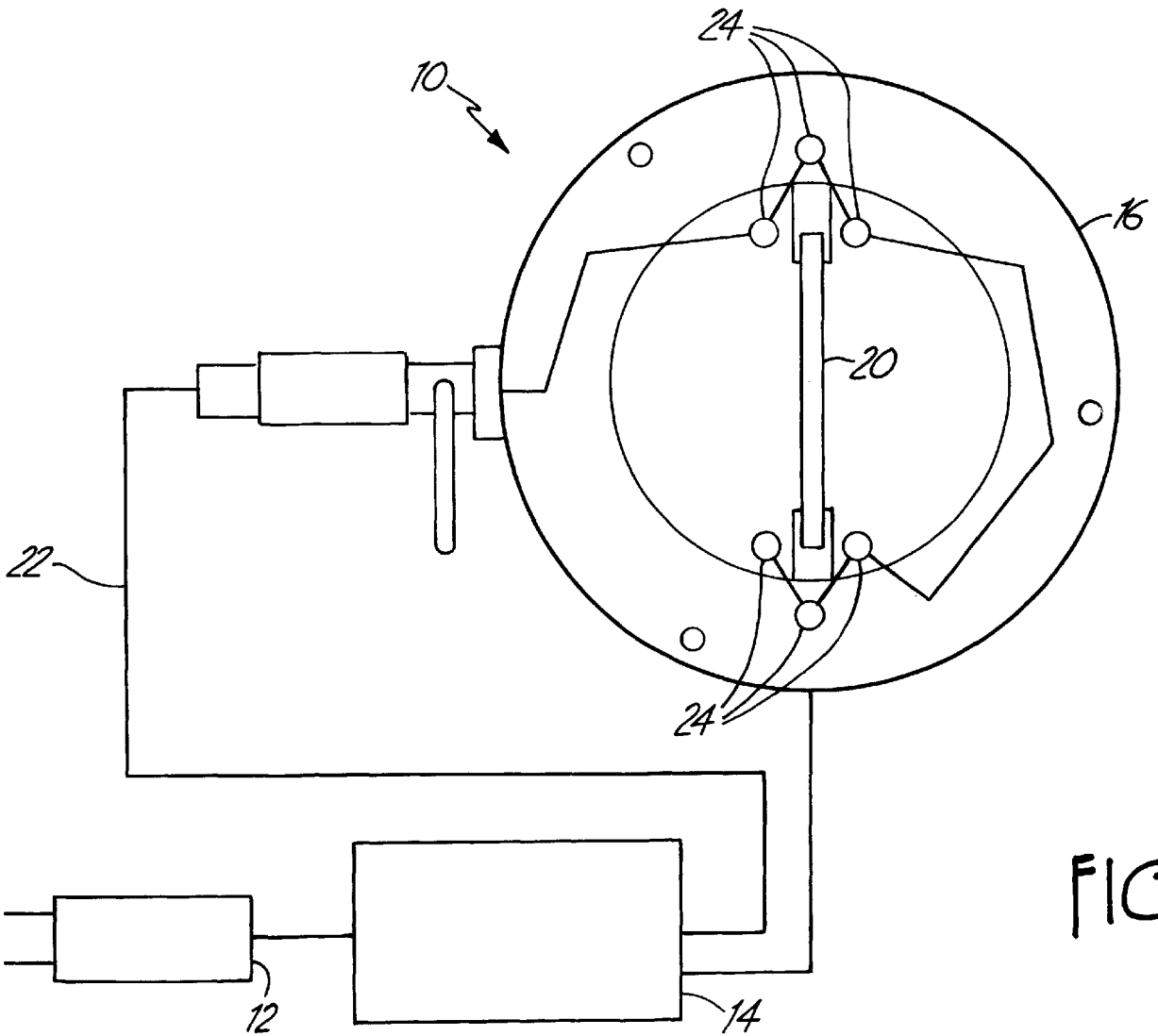
FIG. 1 is a block diagram illustrating the elements of the present invention.

Referring now to FIG. 1, there is shown a block diagram illustrating the parts of the present invention. More specifically, FIG. 1 includes a light fixture 10 along with a power supply 12 and a control unit 14. As is typical, light fixture 10 includes a housing 16 which surrounds and holds a bulb 20. Housing 16 further includes accommodations to provide power to bulb 20 such that the system is capable of providing light. More specifically, electrical power is typically passed through the bulb allowing illumination of a gas or a filament, depending upon the type of bulb used.

As is also well known, bulb 20, while receiving electrical energy, can get very hot. Heat generated by bulb 20 is then capable of igniting other objects such as draperies, clothing, furniture, etc. There is a serious danger of fire whenever objects come into close proximity with bulb 20. The present lighting system includes an automatic bulb shutoff safety system to protect from the possibility of fire when objects come close to bulb 20. More specifically, the safety system includes control unit 14, fiber-optic cable 22 and a plurality of sensors 24 which will cause power to be removed from element when objects are detected in close proximity to bulb 20.

Figure 2:
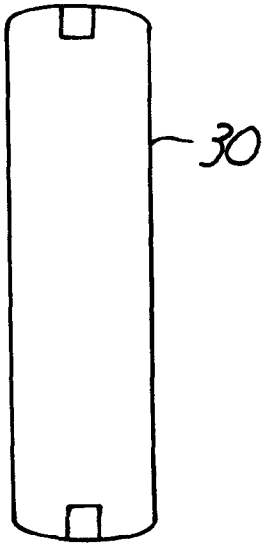
FIG. 2 is a bottom view of the lighting shield utilized in the present invention.

In one embodiment of the present invention, bulb 20 is an elongated halogen bulb spanning a considerable length of housing 16. Placed over and substantially surrounding one side of bulb 20 is a shield 30 which has a substantially concave interior surface. Shield 30 provides a first level of protection for bulb 20 (i.e. it protects from direct contact between foreign objects and bulb 20). The configuration of shield 30 and its placement in relation to bulb 20 can be better seen by referring to FIGS. 2 and 3 which show the shield in top and side view. As can be seen, bulb 20 is positioned on the concave side of shield 30.

Figure 3:
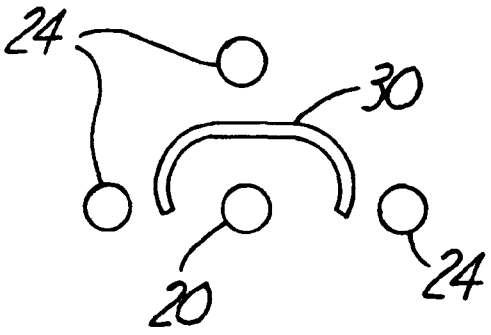
FIG. 3 is an end view of the lighting element and adjacent components.

Referring now specifically to FIG. 3, there is shown one embodiment of the positioning of sensor pairs 24 in relation to shield 30 and bulb 20. As stated, bulb 20 is positioned on the concave side of shield 30. Sensors 24 are thus positioned to create an infrared enclosure around shield 30. Typically these sensor pairs 24 are made up of infrared emitter/receiver pairs such that one sensor will emit an infrared beam whereas a second sensor will then be used for detecting that signal. For example, a photoelectric sensor could be used similar to the HPX Series Photoelectric Sensor/Control manufactured and sold by Honeywell MicroSwitch. Related circuitry can then detect whether the infrared beam has been broken. By utilizing a plurality of sensor pairs 24, shield 30 can be completely surrounded by infrared beams.

It will be understood that several variations are possible for sensor 24. For example, a system utilizing a plurality of mirrors could be used wherein the infrared beams are appropriately reflected along a predetermined path. In this case, any disruption in the continuous infrared beam could still be detected. Additionally, alternative detection signals could be used to completely surround the bulb. For example, light signals of virtually any preselected frequency spectrum could be used.

The important feature of the present safety system is its capability to sense the presence of objects in close proximity to the bulb. Also, it is important that the system then be able to react to the detection of objects by removing power from the bulb, thus eliminating the dangers of fire. While optical systems have been described for use in detection of objects, it is understood that alternative detection systems are equally capable. For example, alternative detection systems may include other optical systems, sonar detectors, motion detectors, etc.

In operation, control unit 14 provides an infrared signal at an output to fiber-optic cable 22. Fiber-optic cable 22 then carries these infrared signals to sensor pairs 24. These sensors then produce the infrared enclosure which is configured to completely surround bulb 20 and housing 30. As previously stated, sensor pairs 24 include emitter/receiver pairs. By cooperating with one another, these emitter/receiver pairs provide an unbroken infrared signal therebetween. However, should an object of any type break or disrupt this uninterrupted signal, control unit 14 will detect this disruption and cause power to be removed from bulb 20. This removal of power will cause the bulb to shut off and thus eliminate any further generation of heat by bulb 20. Consequently, this risk of fire is eliminated.

Figure 4:
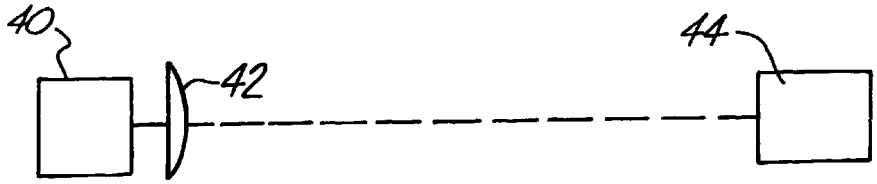
FIG. 4 is a schematic drawing illustrating the operation of the emitter/receiver pairs.

As previously mentioned, sensors 24 include emitter/receiver pairs which cooperate to maintain an unbroken signal therebetween. Referring now to FIG. 4 there is shown a more detailed illustration of this principal. More specifically, each emitter 40 is provided with a lens 42 for appropriately directing the infrared signals. This signal is then directed towards receiver 44 for receipt thereby. Alternatively, each receiver 44 could easily be configured to receive signals from a plurality of emitters 40. Further, the lens could be configured in any number of ways to appropriately direct these infrared signals.

Figure 5:
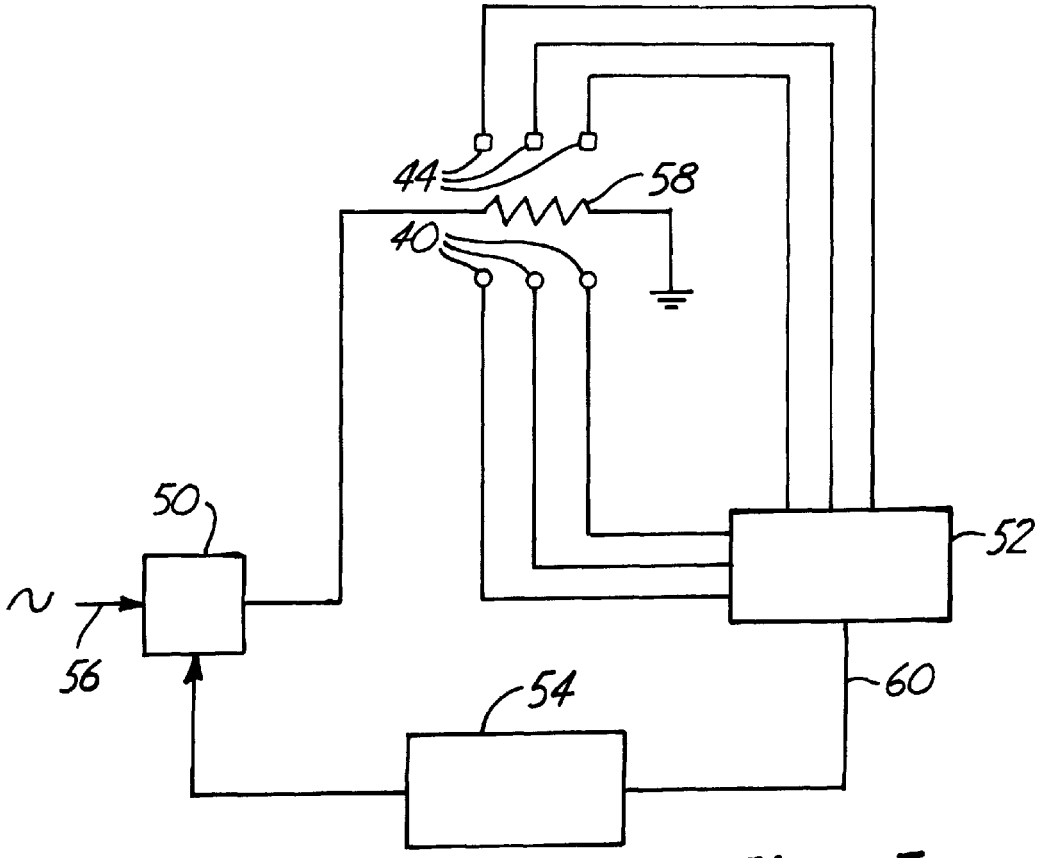
FIG. 5 is a block diagram illustrating the operation of the control circuitry.

To better understand the operation of the present invention, a schematic diagram is shown in FIG. 5. In this Figure, the actual control and switching operations are shown which accomplish the sensing and power removal of the present invention. More specifically, the control device includes a power switching control 50, a sensor monitor 52, and a main controller 54.

In operation, line power or main power is received by power switching control 50 at an input 56. Power switching control 50 includes mechanisms such as relays to pass this power on to bulb 20. In the diagram of FIG. 5, bulb 20 is simply represented as a resistor 58. It is clearly understood that lighting elements may have other characteristics than simple resistance; however, for purposes of this description, further elaboration upon the bulb characteristics themselves are unnecessary.

Switching controller 50 also receives an input from main controller 54. The main controller includes logic circuitry to indicate whether conditions are safe for bulb operation. Consequently, this circuitry is capable of controlling whether power will be directed toward main bulb 20 or not.

As previously referenced, the present invention includes a plurality of emitter/receiver pairs for sensing the presence of foreign objects in close proximity to the bulb. These pairs are shown as emitter 40 and receiver 44 in FIG. 5. In this embodiment, three emitter/receiver pairs are shown in close proximity to bulb resistor 58. Each of these emitter/receiver pairs are monitored by sensor monitor 52. In summary, when an unbroken infrared signal is being passed between each emitter/receiver pair, sensor monitor 52 provides an output signal on its condition output 60 indicative of the safe operation of the bulb. Alternatively, if the infrared beam between the emitter/sensor pair is broken, sensor monitor 52 produces a signal on condition output 60 indicating that unsafe operating conditions have been detected. Main controller 54 can then react to these conditions and have power removed from bulb 20 by appropriately switching power switching controller control 50. In this way, the safe operation of the lighting fixture is achieved.

A second embodiment of the present invention will be described with reference to FIGS. 6–8. This embodiment of the lamp utilizes two separate safety devices. In general, there is a proximity detector system which creates an invisible shield around the bulb for detecting the presence of a foreign object near the bulb. The system subsequently prevents power from reaching the bulb when objects are detected. This detector system is substantially similar to that of the first embodiment.

In addition, a position sensitive switch, or tilt switch, is positioned on the main power supply line to create a second safety system. This switch prevents power from flowing to any down line components when the lamp, and hence the switch, is moved from its normal operating position. Specifically, when the switch is moved from its specified orientation (e.g., upright) all power is shut off to the remaining components of the lamp. This could occur if the lamp was knocked over, if the cord was pulled or tripped over, or any situation where the lamp may fall over.

Figure 6:
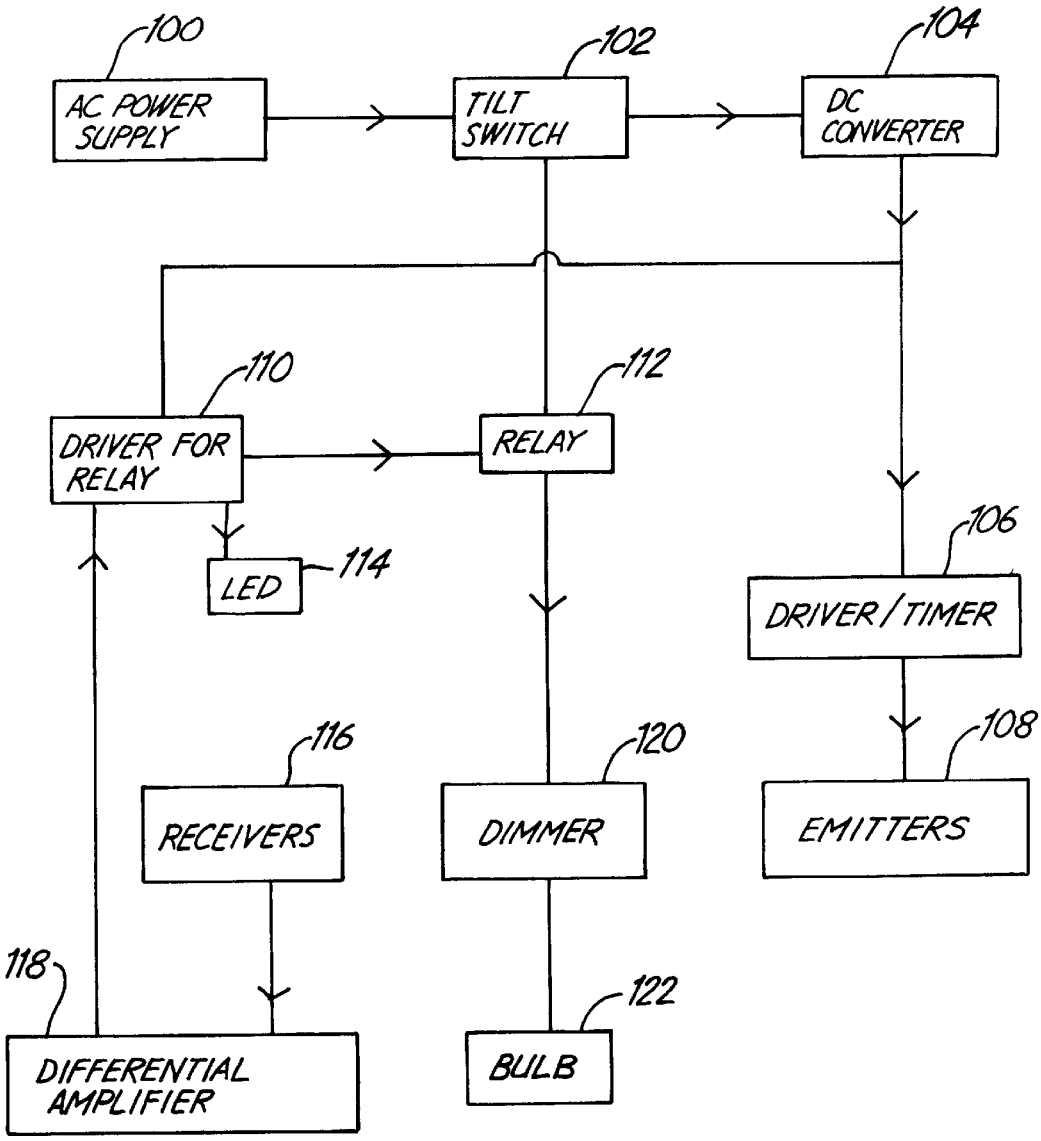
FIG. 6 is a block diagram of a second embodiment of the present invention.

FIG. 6 shows a system diagram of a control system for a safety lamp 90 for use with various lighting fixtures. An AC power supply 100 provides the electrical current required to operate the bulb 120. A tilt switch 102 is the first component in line with the AC power supply 100. As will be explained, there are two separate systems which utilize electrical power in the safety lamp 90. Locating the tilt switch here will prevent either system from obtaining power should the safety lamp 90 be displaced from its normal operating position. Any position or orientation sensitive switch could be incorporated to work as tilt switch 102. For instance, a mercury switch would perform this function by having a ball of mercury close a connection when positioned in an upright orientation. Alternatively, when moved from this upright orientation, the mercury will roll under the influence of gravity and subsequently open the connection. Alternative structures could easily be used such as various hinged metal connectors or different types of spring mechanisms.

When tilt switch 102 is closed, AC power is allowed to flow to DC converter 104 as well as relay 112. The relay 112 is used to control the flow of power to the bulb 120. Relay 112 is a normally open relay which will prevent power from being passed without a control signal being present. When relay 112 is closed, power then flows to the bulb 120, and light is generated. Bulb 120 is meant to generally include any type or number of electrically powered bulbs, including Halogen bulbs. Dimmer switch 122 is connected to the bulb 120 and is in-line with the power supply. Dimmer switch 122 serves to vary the amount of current reaching bulb 120, thus causing the intensity of the light given by bulb 120 to vary accordingly. Any type of dimming device, including but not limited to a rheostat or potentiometer, may be used.

DC converter 104 is used to provide isolation between the power supply and the circuitry involved. This provides protection for the circuitry from electrical surges and spikes. DC converter 104 receives power from AC power supply 100. DC converter 104 coverts the alternating current into a 12 volt DC supply. This can be accomplished in a number of ways, including the use of well known transformers and rectifiers. DC converter 104 then serves as a 12 volt DC power supply for various components of the safety lamp 90. As described above, the DC converter 104 will not function as a power supply if tilt switch 102 is in an open position.

As previously discussed, a plurality of emitters 108 are positioned about the bulb 120. The emitters 108 are paired with an equal number of receivers 116 located on the opposite side of the bulb 120. The emitter/receiver pairs are positioned to form a "shield" that surrounds the bulb. The emitter/receiver combinations should cover a large portion of, or the entirety of the bulb 120. The emitter/receiver pairs serve as a detector. When a foreign object breaks the path between the emitter and its corresponding receiver, a corresponding control signal is lost. The loss of this control signal will then prevent power from reaching the bulb, thus eliminating a potential fire hazard.

Similar to the first embodiment, it is important that the emitter/receiver beam path sufficiently encompass the perimeter of the bulb. This can be accomplished in a number of ways. Simply providing a plurality of the pairs will usually provide adequate coverage. Alternatively, the beam from one emitter can be reflected by a reflecting surface, such as a mirror, so that a single beam protects a larger portion of the bulb. The use of such reflected beams could easily be arranged so as to protect virtually the entire surface area of the bulb.

The emitters 108 are controlled by a driver/timer 106. The present embodiment uses emitters which generate an infrared beam. This is not meant to be limiting as any RF or EIM wavelength could be utilized, dependent on the requirements for use of the specific bulb 120. Infrared is convenient because its components are economical to obtain.

Furthermore, infrared emitters will not be distracting because they do not generate visible light or produce signals which would likely interfere with common household electrical devices. The presence of sunlight and/or additional light sources also makes infrared emitters and receivers a beneficial choice.

One complication in using infrared emitters and detectors is that the bulb 120 will most likely generate signals at the same wavelength. As such, the receivers 116 simply may detect the presence of infrared light which is produced by the bulb, thus preventing the safety system from functioning properly. Even if an object were to break the beam between any given emitter and receiver, the light from the bulb could "trick" the receiver because it is constantly generating energy that could overpower the detector. As such, no object would be detected unless it happened to block the signal from both the emitter and the entirety of the bulb.

To help overcome this problem, emitters 108 are driven by a control circuit such as driver/timer 106. Driver/timer 106 utilizes a timer chip to pulse the emitters 108 at a predetermined frequency. Each receiver 116 is coupled to a differential amplifier circuit 118 which is biased so as to differentiate between the infrared output of the emitters 108 and from the bulb 120. More specifically, the differential amplifier circuit 118 is set up to differentiate between the frequency generated by the timer 106 and any signal created by the bulb. The output from each differential amplifier circuit 118 is then directed to the single input of the relay driver 110.

Figure 7:
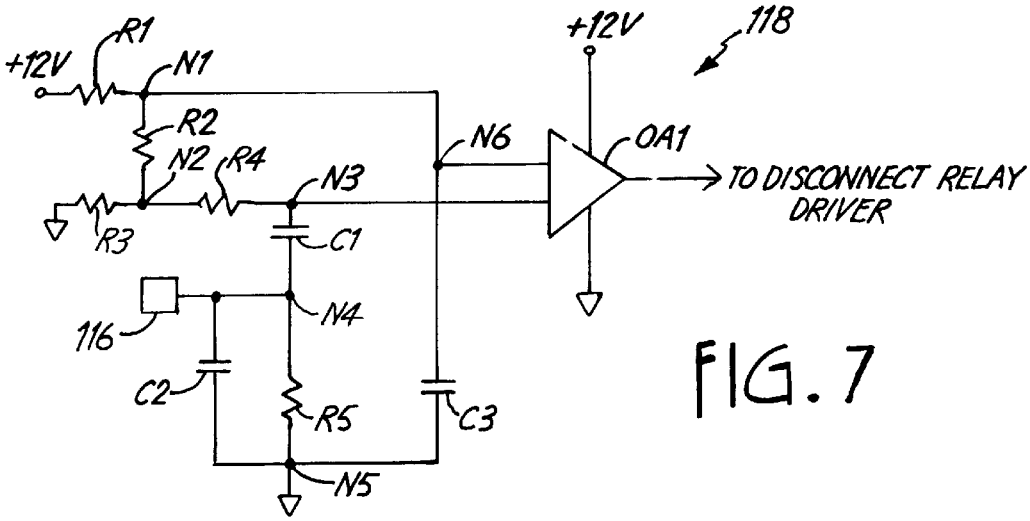
FIG. 7 is a schematic circuit diagram of a differential amplifier circuit.

FIG. 7 illustrates one circuit arrangement of the differential amplifier 118 including receiver 116, which would accomplish this differentiation. Node N4 connects the output of receiver 116 to node N3 through capacitor C1. A capacitor C2 and resistor R5 are connected in parallel between node N4 and ground through node N5. A 12 volt power supply is connected to node N1 across resistor R1. Resistor R2 connects node N1 to node N2. Resister R3 connects node N2 to ground. Node N2 is connected to node N3 across resistor R4. Node N1 provides a first input to op amp OA1 and is also connected to ground through node N5 by capacitor C3. Node N3 provides a second input into op am OA1.

Resistors R1, R2, R3 create a voltage divider network which establishes the trip point for amplifier OA1. This allows the circuit of the present invention to accommodate various bias levels created when the detector picks up signals from the bulb element. Further, capacitors C2 and C3 operate as filtering capacitors to remove low level noise from the supply signal and the emitter signal. All of these work in conjunction with one another to create a pulsed signal at the output of amplifier OA1 which is passed on to relay driver circuit 110. The use of differential amplifiers 118 is beneficial as those devices will self-adjust for any lighting condition. Thus the system of the present invention will work in all lighting conditions, including those where the bulb is illuminated to its fill intensity and those where the bulb is considerably dimmed.

It is important to note that most lamps will use a plurality of emitters 108 and a corresponding number of receivers 116. The use of a number of emitter/receiver pairs allows more area to be protected. The circuit is specifically set up to accommodate any number of emitter/receiver pairs. While the particular number of emitter/receiver pairs may vary, a separate differential amplifier 118 is required for every receiver 116 used.

The input to relay driver circuit 110 is coupled to the outputs of all the differential amplifier circuits 118. Relay driver circuit 110 includes relay timer 126. Relay timer 126 and driver/timer 106 are two portions of a single unit and are therefore synchronized. Relay 112 is coupled to the output of relay driver circuit 110. Relay 112 is physically located proximate the power supply line to the bulb 120 so as to control whether power is supplied thereto. Relay driver circuit 110 can open and close relay 112, thus allowing or preventing power to flow to the bulb 120. Unlike tilt switch 102, when relay 112 is opened power is still allowed to flow to the DC converter 104, and thus to the 12 volt components as well. This allows the emitters 108 and receivers 116 to continue to function. As a result, when the foreign object interrupting the beam between the respective emitter/receiver pair is removed, the bulb 120 will automatically be turned back on. Of course, a reset could be added so that if the emitter/receiver is tripped, the light will not automatically turn back on when the foreign object is removed, but instead will require some type of manual reset.

Figure 8:
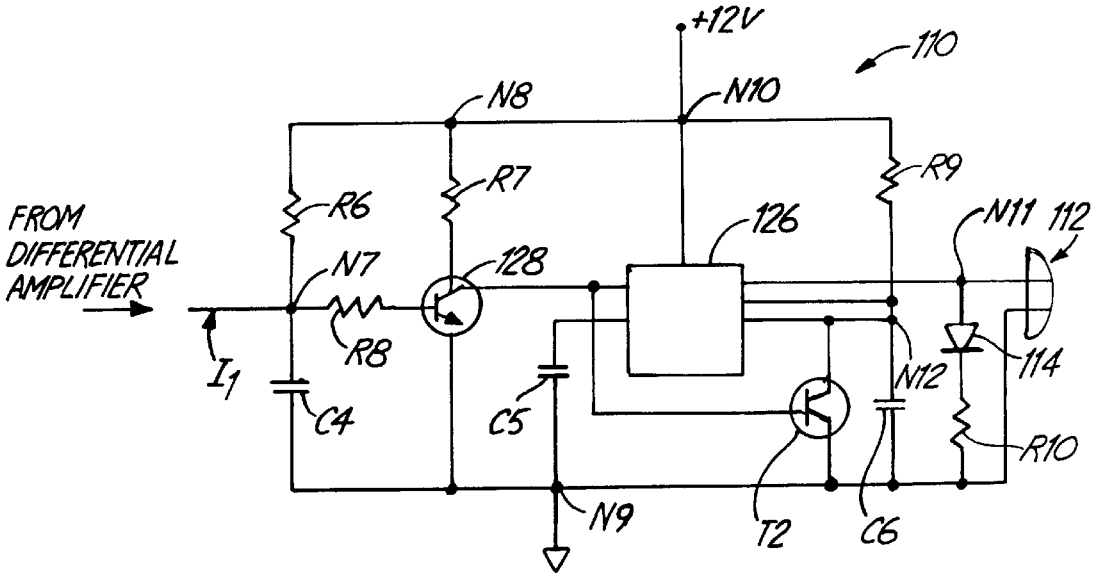
FIG. 8 is a schematic circuit diagram of a relay driver.
Figure 9:
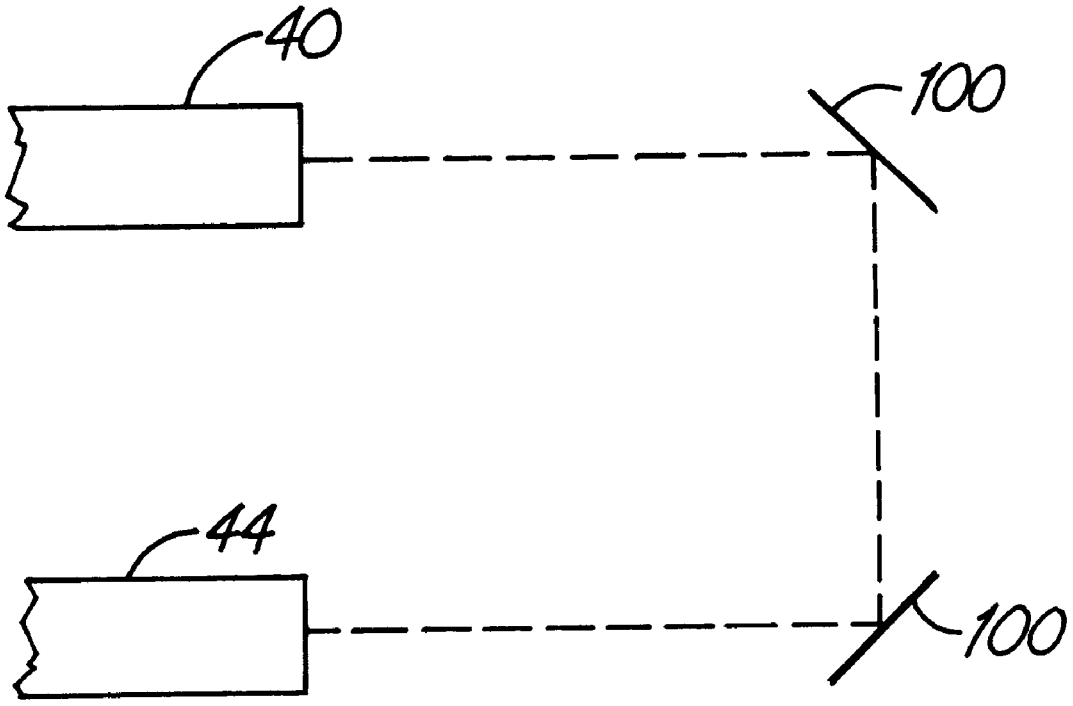
FIG. 9 is a schematic representation of an emitter/detector pair in combination with a plurality of mirrors.

FIG. 8 illustrates one possible circuit which functions as the relay driver circuit 110. The outputs from the various op amps (OA1 as shown in FIG. 7) are all fed into the relay timer/driver 126 at input I1. Input I1 is connected to node N7. A capacitor C4 is coupled between node N7 and ground through node N9. A pull up resistor R6 is connected between node N7 and node N10. Another resistor R8 is connected between node 7 and the base of drive transistor 128. The collector of drive transistor 128 is connected to the relay timer chip 126. The emitter of transistor 128 is connected to ground through node N9. A capacitor C5 is connected between the relay timer/driver 126 and ground through node N9. The base of a second transistor T2 is connected to the collector of drive transistor 128. The emitter of transistor T2 is connected to ground through node N9. The collector of transistor T2 is connected to node N12. An output from relay timer/driver 126 is connected to node N12, and a capacitor C6 connects node N12 to ground through node N9. A +12 volt supply is connected to node N10. Node N10 is connected to relay timer/driver chip 126. A resistor R9 is connected between node N10 and node N12. Node N11 connects relay timer/driver 126 to relay 112 and LED 114. Resistor R10 connects LED 114 to ground through node N9. The circuit includes a relay timer/driver 126. The outputs from all of the differential amplifiers 118 (there is one for every receiver) are connected to a summing point at node N7 of the relay driver circuit 110. Relay driver circuit 110 must include a summing function to insure that all emitter/receiver pairs are communicating. By connecting all differential amplifiers in this way, the circuit can thus accommodate any number of emitter receiver pairs.

LED 114 is incorporated into the relay driver circuit 110. The LED glows when no interruption is detected by any emitter/receiver combination, thus alerting an operator that the bulb 120 is free from obstruction even when the lamp is not generating light. This feature is helpful in that the operator will easily be able to determine why the lamp is not working; i.e., whether there is foreign material near the bulb (the LED is off) or whether there is a mechanical problem, such as a burned out bulb (the lamp does not work, but the LED is on).

As mentioned above, the emitter driver/timer 106 and the relay timer/driver 126 are two segments of the same component and thus are synchronized. When the timer sends a controlled output signal, usually a pulsed wave, the emitter 108 is triggered and emits a pulse. At the same time, based on the same controlled signal, the relay timer/driver 126 checks the output of the receivers 118. Thus, the emitter is pulsed, based upon the pulsed wave generated by the emitter timer/driver 106. When the emitter signal is low, the receiver 116 receives a signal only from the bulb 120. This signal is then used by the differential amplifier 118 as a floating reference point. When the emitter signal goes high and the receiver 116 receives input from both the bulb 120 and the emitter 108, the output from the receiver will be a stronger signal. The differential amplifier 118 detects the pulse signal and produces a pulsed output which has all bias removed. Each time the signal from the emitter goes low, a new floating reference is established, thus allowing the system to function properly when the intensity of the bulb 120 is adjusted.

All of the outputs from the various op amps OA1 in the various differential amplifiers 118 are coupled to a single input into the relay driver circuit 110. Each time the timer/driver 106,126 sends a pulse, the input into the relay driver circuit 110 is monitored. Referring to FIG. 8, so long as all of the outputs of the differential amplifiers are high, the drive transistor 128 remains on and a control signal reaches the relay driver 126. When such a signal is received, the relay driver 126 maintains the relay 112 in a closed position and power flows to the bulb 120. If the output from any of the differential amplifiers goes low, the drive transistor turns off and no signal will reach the relay driver 126. Therefore, when the relay driver 126 attempts to monitor the input, no signal will be received and the relay 112 is triggered to open, thus preventing power from flowing to the bulb 120.

In use, when no emitter/receiver combination detects a foreign object near the bulb, the relay driver 110 sets the relay 112 to a closed position. Power is then allowed to flow directly to bulb 120. If an object crosses the beam generated by any emitter 108, its corresponding receiver 116 will not receive infrared light at the proper pulsed frequency. This will trigger the relay driver 110 to open the relay 112. When relay 112 is opened, power is prevented from reaching bulb 120. An additional advantage of this arrangement is that no component, including the relay 112 is caused to remain on continuously. Each component is pulsed, thus extending its life. In the case of the relay 112, its normal position is open. Thus, if no power were provided to the relay driver 126, the relay 112 would open as a default. To remain closed, the relay 112, must receive a control signal from the driver 126. Since this is not a continuous signal, the relay driver circuit 112 is set at a timing dropout point that is larger than the operating frequency.

While the above mentioned detection system has been described in conjunction with a lighting system, the detector network and related circuitry could easily be used in numerous applications. For example, in a manufacturing operation where heavy-duty presses are used, these detectors could be used to ensure that the area underneath the press is clear immediately prior to its pressing stroke. As the present invention is not sensitive to various lighting conditions, the control circuitry would thus operate satisfactorily under all manufacturing circumstances. Thus, the system could be used as a safety system to ensure safe operation in this example of a manufacturing condition. Obviously, other conditions exist where the advantages of this invention could similarly be exploited.

Having illustrated and described the principles of the invention in the preferred embodiment, it should be apparent to those skilled in the art that the invention can be modified in arrangement and detail without departing from such principles. We claim all modifications coming within the scope and spirit of the following claims.

It is claimed:

1. A safety lamp having its operating power supplied by a power source, comprising:

a bulb;

a timing and driving circuit;

an emitter located proximate the bulb, and coupled to the timing and driving circuit so as to emit a pulsed beam at a predetermined frequency;

a receiver located proximate the bulb and positioned to receive the pulsed beam from the emitter;

a differential amplifier circuit coupled to the receiver, the differential amplifier circuit determining whether the pulsed beam has been received;

a relay driver circuit coupled to at least one differential amplifier circuit, the relay driver circuit producing a close signal when at least one receiver receives the pulsed signal, and an open signal when at least one receiver does not receive the pulsed signal;

a relay connected to the power source, the bulb and the relay driver, the relay allowing power to reach the bulb when the relay is closed, and preventing power from reaching the bulb when the relay is open.

2. The safety lamp of claim 1, further comprising:

a tilt switch coupled to the bulb, the tilt switch allowing power to pass through when closed, and preventing power from passing through when open, wherein the tilt switch is closed when the lamp is in a normal operating orientation and the tilt switch automatically opens when the lamp is moved into an abnormal operating orientation.

3. The safety lamp of claim 2, wherein the tilt switch is a mercury switch.

4. The safety lamp of claim 2, wherein the tilt switch includes a hinged metal contact.

5. The safety lamp of claim 2, wherein the normal operating orientation is vertical.

6. The safety lamp of claim 2, wherein the normal operating orientation is horizontal.

7. The safety lamp of claim 1, wherein the emitter emits pulsed infrared beams.

8. The safety lamp of claim 1, wherein the bulb is a halogen bulb.

9. The safety lamp of claim 1, further comprising a LED coupled to the relay driver circuit, the LED turning on or off dependent upon whether the receiver receives the pulsed beam.

10. The safety lamp of claim 9, wherein the LED is turned on when the receiver receives the pulsed beam.

11. The safety lamp of claim 9, wherein the LED is turned on only when the receiver does not receive the pulsed beam.

12. The safety lamp of claim 1, further comprising:

a plurality of the emitters and a plurality of the receivers form a sensory shield around substantially the whole bulb; and for each of the receivers used, a separate one of differential amplifiers is used.

13. A safety lamp comprising:

a housing;

a bulb mounted in the housing;

a power supply coupled to the bulb via a relay to energize the bulb, thus generating light;

a detector proximate the bulb, the detector including a driving circuit, an emitter adjacent the bulb, a receiver adjacent the bulb, and a differential amplifier circuit, wherein the driving circuit is attached to the emitter and drives the emitter to produce a predetermined energy signal, the receiver is positioned to receive the predetermined energy signal and coupled to the differential amplifier circuit, the differential amplifier circuit for determining when the predetermined energy signal has not been received thus indicating the presence of an object in close proximity to the bulb; and a control circuit having an input connected to the differential amplifier and an output connected to the relay, the control circuit causing the relay to open and disengage power to the bulb when the predetermined energy signal is not detected, the control circuit for further closing the relay and allowing power to pass to the bulb when the predetermined energy signal is received.

14. The safety lamp of claim 13, further comprising:

a tilt switch mounted in the housing and coupled between the power supply and the bulb, the tilt switch allowing power to flow to the bulb when the tilt switch is in a first orientation, and the tilt switch preventing power from flowing when the tilt switch is not in the first orientation.

15. The safety lamp of claim 14, wherein the tilt switch closes a switch when in the first orientation and opens the switch when in any other orientation.

16. The safety lamp of claim 14 wherein the tilt switch is a mercury switch.

17. The safety lamp of claim 14, wherein the tilt switch includes a hinged metal contact.

18. The safety lamp of claim 13, wherein the predetermined energy signal is a beam of light.

19. The safety lamp of claim 18, wherein the emitter emits the beam of light in pulses at a predetermined frequency; and the receiver detects the beam of light at the predetermined frequency.

20. The safety lamp of claim 18, wherein the beam of light is infrared.

21. The safety lamp of claim 13, further comprising a plurality of the emitters, a plurality of the receivers and a plurality of the differential amplifiers, wherein the plurality of differential amplifiers output to a single input of the control circuit.

22. The safety lamp of claim 13, further comprising a LED coupled to the control circuit, the LED turning on or off dependent upon whether the receiver detects the predetermined energy signal.

23. The safety lamp of claim 22, wherein the LED is turned on when the receiver detects the predetermined energy signal.

24. The safety lamp of claim 22, wherein the LED is turned on only when the receiver does not receive the predetermined energy signal.

25. The safety lamp of claim 14 wherein detector further includes:

a reflecting surface disposed between the emitter and the receiver, the reflecting surface receiving the predetermined energy signal from the emitter and redirecting the predetermined energy signal to the receiver.

26. A safety lamp for attachment to a power source, comprising:

a housing;

a bulb mounted in the housing;

a tilt switch mounted in the housing and disposed between the power supply and the bulb, the tilt switch allowing power from the power source to pass through when closed, and preventing power from passing through when open, wherein the tilt switch is closed when the lamp is in a normal operating orientation and the tilt switch automatically opens when the lamp is moved into an abnormal operating orientation;

a timer and driving circuit mounted in the housing;

an emitter located proximate the bulb, the emitter coupled to the timer and driving circuit to emit a pulsed beam at a predetermined frequency;

a receiver located proximate the bulb, opposite the emitter, the receiver receives the pulsed beam;

a differential amplifier circuit coupled to the receiver, the differential amplifier circuit determining whether the pulsed beam has been received;

a relay mounted in the housing;

a relay driver circuit mounted in the housing, coupled to the differential amplifier circuit and the relay, the relay driver circuit causing the relay to close and allow power to reach the bulb when the receiver receives the pulsed signal, and causing the relay to open and prevent power from reaching the bulb when the receiver does not receive the pulsed signal.

27. A safety device for a system, comprising:

a timing and driving circuit;

an emitter coupled to the timing and driving circuit so as to emit a pulsed beam at a predetermined frequency;

a receiver positioned to receive the pulsed beam from the emitter;

a differential amplifier circuit coupled to the receiver, the differential amplifier circuit determining whether the pulsed beam has been received;

a control circuit coupled to at least one differential amplifier circuit, the control circuit producing a first signal when at least one receiver receives the pulsed signal, and a second signal when at least one receiver does not receive the pulsed signal wherein the first and second signal provide a safety control for the system.

28. The safety device for a system of claim 27, further comprising:

a relay, the relay being coupled to the control circuit and the system so that the relay allows power to flow to the system when the control circuit produces the first signal and prevents power from flowing to the system when the control circuit produces the second signal.

29. The safety device for a system of claim 27 wherein the safety device functions as a proximity detector so that the first signal is indicative of no object being located between the emitter and the receiver and the second signal being indicative of an object being located between the emitter and the receiver.

* * * * *